US006593844B1

(12) United States Patent
Iwao et al.

(10) Patent No.: US 6,593,844 B1
(45) Date of Patent: Jul. 15, 2003

(54) PTC CHIP THERMISTOR

(75) Inventors: Toshiyuki Iwao; Koichi Morimoto, both of Osaka; Kiyoshi Ikeuchi, Hyogo; Junji Kojima; Takashi Ikeda, both of Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/868,028

(22) PCT Filed: Oct. 15, 1999

(86) PCT No.: PCT/JP99/05706

§ 371 (c)(1),
(2), (4) Date: Jun. 13, 2001

(87) PCT Pub. No.: WO00/24010

PCT Pub. Date: Apr. 27, 2000

(30) Foreign Application Priority Data

Oct. 16, 1998 (JP) ..... 10-294946
Jun. 1, 1999 (JP) ..... 11-153292

(51) Int. Cl.[7] ..... H01C 7/10
(52) U.S. Cl. ..... 338/22 R; 338/328; 338/332
(58) Field of Search ..... 338/22 R, 225 D, 338/328, 332

(56) References Cited

U.S. PATENT DOCUMENTS

| | | | | | |
|---|---|---|---|---|---|
| 4,290,041 | A | * | 9/1981 | Utsumi et al. | 338/21 |
| 5,075,665 | A | * | 12/1991 | Taira et al. | 338/21 |
| 5,245,309 | A | * | 9/1993 | Kawase et al. | 338/22 R |
| 6,008,717 | A | * | 12/1999 | Kawase et al. | 338/22 R |
| 6,020,808 | A | * | 2/2000 | Hogge | 338/22 R |
| 6,023,403 | A | | 2/2000 | McGuire et al. | |
| 6,078,250 | A | * | 6/2000 | Ueda et al. | 338/313 |
| 6,157,289 | A | * | 12/2000 | Kojima et al. | 338/22 R |
| 6,172,591 | B1 | * | 1/2001 | Barrett | 338/22 R |
| 6,184,769 | B1 | * | 2/2001 | Nakamura et al. | 338/21 |
| 6,188,308 | B1 | * | 2/2001 | Kojima et al. | 338/22 R |
| 6,236,302 | B1 | * | 5/2001 | Barrett et al. | 338/22 R |
| 6,242,997 | B1 | | 6/2001 | Barrett et al. | |

FOREIGN PATENT DOCUMENTS

| | | |
|---|---|---|
| JP | 4-346409 | 12/1992 |
| JP | 6-061014 | 3/1994 |
| JP | 6-44101 | 6/1994 |
| JP | 6-208903 | 7/1994 |
| JP | 9-69416 | 3/1997 |
| JP | 9-503097 | 3/1997 |
| JP | 10-12404 | 1/1998 |
| WO | 98/12715 | 3/1998 |

OTHER PUBLICATIONS

International Search Report corresponding to application No. PCT/JP99/05706 dated Jan. 25, 2000.
English translation of PCT/ISA/210, Sep. 14, 2000.
International Search Report for PCT/JP00/01228 dated Jun. 6, 2000.
English translation of PCT/ISA/210 Jun. 6, 2000.

* cited by examiner

*Primary Examiner*—Karl D. Easthom
(74) *Attorney, Agent, or Firm*—RatnerPrestia

(57) ABSTRACT

A chip PTC thermistor comprising a conductive polymer having PTC properties, a first outer electrode, a second outer electrode, one or more inner electrodes sandwiched between the conductive polymer, a first electrode electrically directly coupled with the first outer electrode, and a second electrode. The odd-numbered inner electrode among the one-or-more inner electrodes is directly coupled with the second electrode, while the even-numbered inner electrode, with the first electrode. When total number of the inner electrodes is an odd number the second outer electrode makes direct electrical contact with the first electrode, when it is an even number the second outer electrode makes direct electrical contact with the second electrode. Defining a distance from the odd-numbered inner electrode to the first electrode, or from the even-numbered inner electrode to the second electrode, as "a", while a distance between the adjacent inner electrodes, or a distance between the inner electrode placed the most adjacent to the first outer electrode, or the second outer electrode, and the first outer electrode, or the second outer electrode, as "t"; the PTC thermistors are constituted so that a ratio a/t is within 3–6. The chip PTC thermistors in accordance with the present invention effectively prevent an overcurrent in large current circuits.

14 Claims, 19 Drawing Sheets

PTC CHIP THERMISTOR

THIS APPLICATION IS A U.S. NATIONAL PHASE APPLICATION OF PCT INTERNATIONAL APPLICATION PCT/JP99/05706.

FIELD OF THE INVENTION

The present invention relates to a chip positive temperature coefficient (hereinafter, PTC) thermistor comprising conductive polymers having PTC properties. The present invention particularly relates to a laminated chip PTC thermistor.

BACKGROUND OF THE INVENTION

PTC thermistors have been used as an overcurrent protection element. When an electric circuit gets overloaded, conductive polymers of a PTC thermistor, which have PTC properties, emit heat and thermally expand to become high resistance, thereby reducing the current in the circuit to a safe small current level.

The following is a description of a conventional laminated chip PTC thermistor (hereinafter, PTC thermistor).

The Japanese Patent Application Laid Open Publication No. H9-69416 discloses a structure of the conventional chip PTC thermistors. A conductive polymer sheet and an internal electrode of metal foil are alternately laminated so that number of the conductive polymer sheets is more than two, for providing a PTC thermistor element. Terminals coupled respectively with the opposing internal electrodes are provided on opposite side faces to complete a finished chip PTC thermistor.

FIG. 20 is a cross section of a conventional chip PTC thermistor. Referring to FIG. 20, a conductive polymer 1 is formed of polyethylene or the like high polymer sheet material mixed with carbon black or the like conductive particles and cross-linked. Internal electrode 2*a,* 2*b,* 2*c,* 2*d* made of a conductive material and a conductive polymer sheet 1 are laminated to form a PTC thermistor element 3. Provided on the side faces of the thermistor element 3 are terminals 4*a* and 4*b,* which are coupled respectively with the internal electrodes 2*a,* 2*c* and 2*b,* 2*d.*

However, the above-described structure of conventional PTC thermistors exhibits following problems when they are intended to be made smaller in size, or capable of larger current.

In order to make a PTC thermistor to be compact and capable of handling a large current, the DC resistance of the PTC thermistor needs to be lowered. For reducing the specific resistance of the conductive polymer 1, it is effective to increase amount of the conductive particles contained in the conductive polymer. However, the increased conductive particles also effects a deterioration in the rising rate of the resistance, which being a key PTC characteristic, rendering it difficult to cut off the electric current when an abnormality happens.

The resistance can be lowered also by reducing the thickness of conductive polymer 1 placed among the internal electrodes 2*a,* 2*b,* 2*c,* 2*d.* However, this measure also leads to a deterioration in the rising rate of the resistance, like in the earlier example, and to a lowered withstanding voltage.

Furthermore, the resistance can be lowered also by increasing the opposing area of the internal electrodes 2*a,* 2*b,* 2*c,* 2*d.* The opposing area can be increased by increasing the number of laminated layers. However, the increased layers result in a greater thickness with a laminated body, which readily leads to a lower reliability in the connection between the internal electrodes 2*a,* 2*b,* 2*c,* 2*d* and the terminals 4*a,* 4*b,* being affected by a mechanical stress caused by expansion of the conductive polymer 1. Thus, there is a limitation in the increasing the number of layers.

Therefore, in order to lower the resistance, the effective opposing area per layer must be increased by making the distance between the internal electrodes 2*a,* 2*b,* 2*c,* 2*d* and the terminals 4*a,* 4*b* shorter. However, the portion of the conductive polymer 1 locating in the vicinity of the terminals 4*a,* 4*b* is physically restricted by the internal electrodes 2*a,* 2*b,* 2*c,* 2*d,* which means that it is not easy for the conductive polymer 1 to expand. As a result, when an overcurrent causes an expansion with the conductive polymer 1, the expansion remains small in the vicinity of the terminals 4*a,* 4*b,* leaving the specific resistance in the region to be small as compared with that in other regions. So, the rising rate of the resistance is impaired with a PTC thermistor whose distance between the internal electrodes 2*a,* 2*b,* 2*c,* 2*d* and the terminals 4*a,* 4*b* is short. Thus, the PTC thermistors had a problem that there is a possibility for the rising rate of the resistance to become low, if lowering of the resistance is intended to be realized through introduction of a laminated structure and increase in the effective opposing area.

The present invention addresses the above drawbacks, and aims to provide a chip PTC thermistor that is compact in shape, yet it is usable in the large current applications with a sufficient rising rate in the resistance.

SUMMARY OF THE INVENTION

A chip PTC thermistor of the present invention comprises:

a) a conductive polymer having PTC properties;

b) a first outer electrode in contact with the conductive polymer;

c) a second outer electrode sandwiching the conductive polymer with the first outer electrode;

d) one or more inner electrode disposed in between and parallel to the first and second outer electrodes and sandwiched with the conductive polymer;

e) a first electrode electrically directly coupled with the first outer electrode; and f) a second electrode disposed electrically independently from the first electrode.

Where; when counting from one inner electrode, which is the closest to the first outer electrode, an inner electrode in the "n"th position is called as the "n"th inner electrode. If "n" is an odd-number, the inner electrodes are directly coupled with the second electrode; whereas, if "n" is an even-number, the inner electrodes are directly coupled with the first electrode. When the total number of the inner electrodes is an odd number, the second outer electrode is electrically directly coupled with the first electrode; whereas, if the total number of the inner electrodes is an even number, the second outer electrode is electrically directly coupled with the second electrode.

In the above PTC thermistor, distance from the odd-numbered inner electrode to the first electrode, or that from the even-numbered inner electrode to the second electrode, is defined as "a", while distance among the adjacent inner electrodes, or distance from an inner electrode, locating next to the first outer electrode or the second outer electrode, to the first outer electrode, or the second outer electrode, is defined as "t", "a" and "t" satisfy a relation of a/t=3–6.

In accordance with a structure that meets the above-described requirement, resistance of a PCI thermistor can be maintained low, and, at the same time, the rising rate of the resistance can be made sufficiently high. Thus the PCT thermistors of the present invention can be used for large current applications despite their compact size, and provide a sufficient capability for preventing an overcurrent. The terminology, "the rising rate of the resistance ", used here with a PTC thermistor is defined as a ratio of resistance at an overcurrent divided by resistance at a normal current. The PTC thermistors in accordance with the present invention obtains the above-described functions and capabilities by controlling the parameters to be a/t=3–6.

BRIEF DESCRIPTION OF THE DRAWINGS

FIG. 1(*b*) is a sectional view, sectioned at A–A' line of FIG. 1(*a*).

FIG. 4(*b*) is a graph showing results of measurement at 125° C. in the first exemplary embodiment.

DESCRIPTION OF THE PREFERRED EMBODIMENTS

First Exemplary Embodiment

Figure 1:
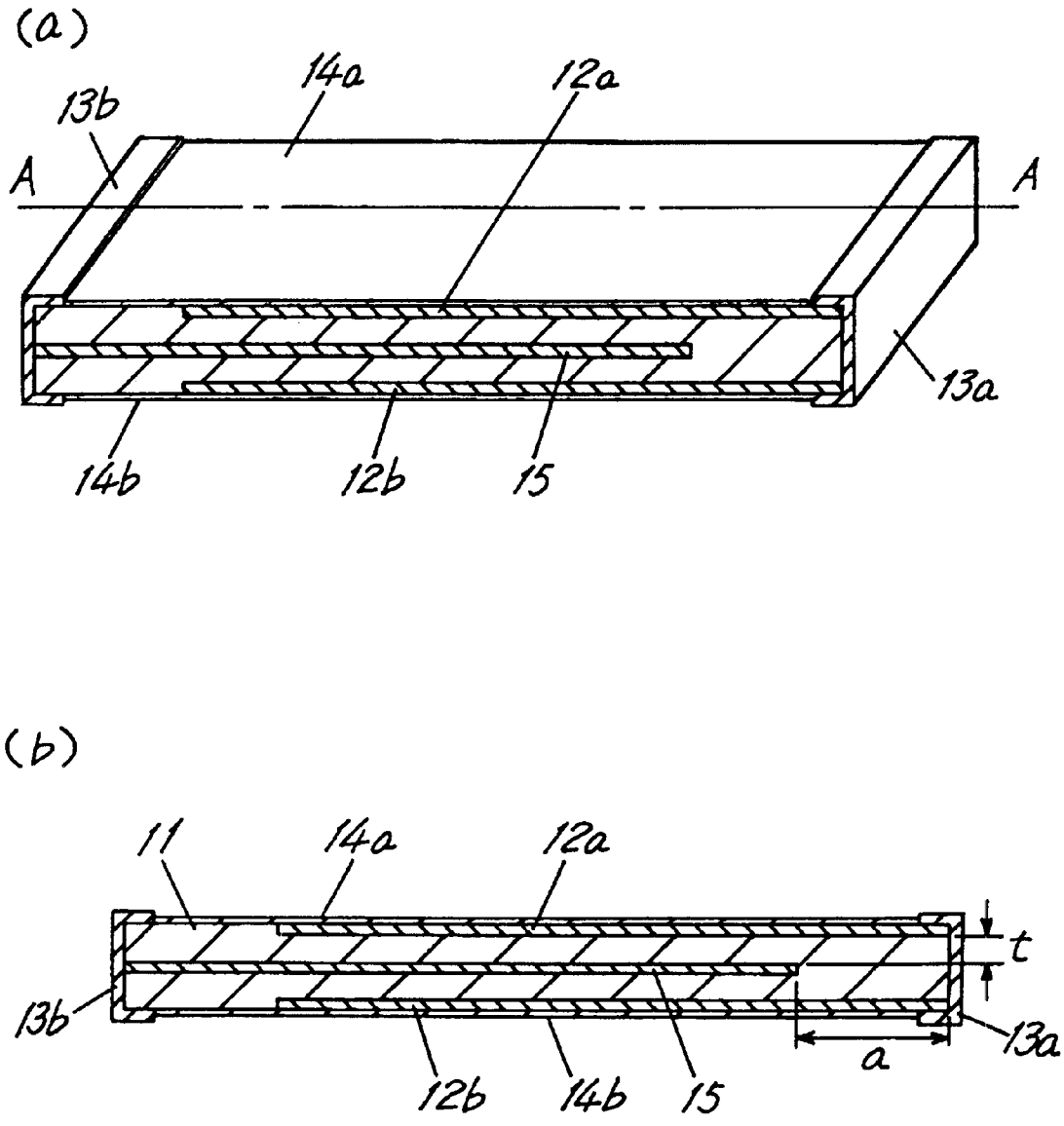
FIG. 1(*a*) is a perspective view of a PTC thermistor in accordance with a first exemplary embodiment of the present invention.

A PTC thermistor in accordance with the first exemplary embodiment of the present invention is described referring to the drawings.

FIG. 1(*a*) is a perspective view of a PTC thermistor in accordance with the first exemplary embodiment of the present invention and FIG. 1(*b*) is the cross sectional view, sectioned at the line A–A' of FIG. 1(*a*).

Referring to FIGS. 1(*a*) and (*b*), a conductive polymer 11 is a mixture of a high density polyethylene, which is one of the crystalline polymers, and carbon black, which is a conductive particle. The conductive polymer 11 is provided with the PTC properties. A first outer electrode 12*a* is provided on a first surface of the conductive polymer 11, and a second outer electrode 12*b* on a second surface opposite the first surface of the conductive polymer 11. Each of the first and the second outer electrodes is formed of a metal foil, such as copper, nickel or the like. A first electrode 13*a* comprising a nickel plating layer is provided to cover the entire surface of one of the side faces of the conductive polymer 11 as well as end portions of the first outer electrode 12*a* and the second outer electrode 12*b,* electrically coupling them. A second electrode 13*b* comprising a nickel plating layer is provided to cover the entire surface of the other side face of the conductive polymer 11 as well as end portions of the first and the second surfaces of the conductive polymer 11. A first and a second protective coating 14*a* and 14*b* are formed of an epoxy modified acrylic resin, and are provided on the outermost surface of the first and the second surfaces of the conductive polymer 11. An inner electrode 15 is formed of a metal foil, such as copper, nickel and the like, and is provided in the conductive polymer 11, in parallel to the outer electrodes 12*a* and 12*b,* and electrically coupled with the side electrode 13*b*.

A method for manufacturing the above-configured PTC thermistor in accordance with first embodiment is described with reference to the drawings.

Figure 2:
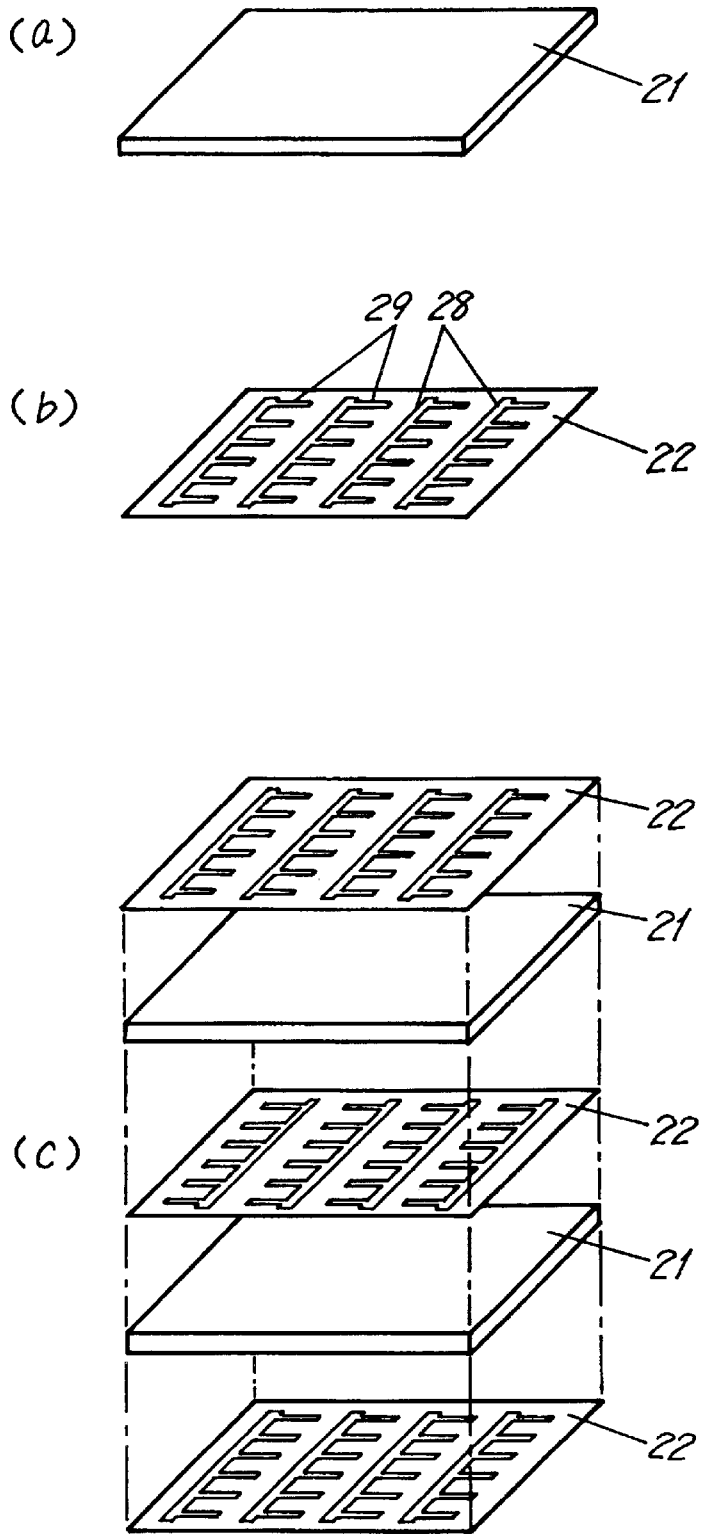
FIGS. 2(*a*)–(*c*) are flow charts showing a method of manufacturing a PTC thermistor in the first embodiment.
Figure 3:
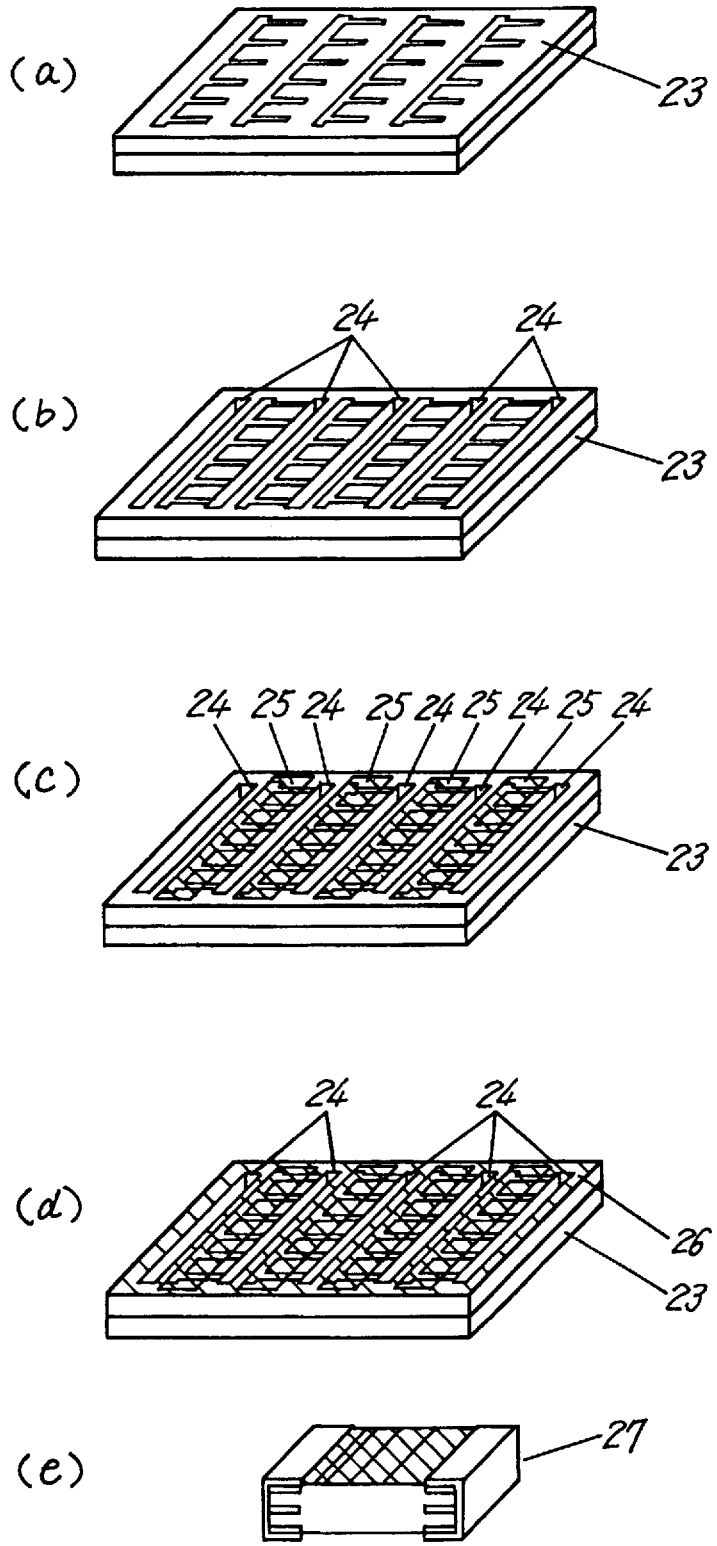
FIGS. 3(*a*)–(*e*) are flow charts showing a method of manufacturing a PTC thermistor in the first exemplary embodiment.

FIGS. 2(*a*)–(*c*) and FIGS. 3(*a*)–(*e*) are process charts showing a method of manufacturing the PTC thermistor in first embodiment.

First, a 0.16 mm thick conductive polymer sheet 21 shown in FIG. 2(*a*) is manufactured by mixing the following materials in a hot 2-roll mill at approximately 170° C. for about 20 minutes and then the mixture is pulled out of the 2-roll mill in the form of a sheet:

a 42 weight % (wt %) of high density polyethylene, having a crystallinity of 70–90%, a 57 wt % of furnace carbon black, having an average particle diameter of 58 nm, specific surface area of 38 $m^2/g$, and a 1 wt % of anti-oxidant.

An electrolytic copper foil of approximately 80 $\mu$m thick is pressed by a metal mold to form a pattern of electrodes 22 as shown in FIG. 2(*b*). A groove 28 shown in FIG. 2(*b*) is for providing gaps between the side electrode and the outer electrode, or the inner electrode, so that the respective electrodes are separated from each other for a predetermined distance, after being divided into independent pieces in a later process stage. A groove 29 is for preventing burrs on the electrolytic copper foil, by reducing an area of the electrolytic copper foil being cut during the dividing process. The groove 29 also prevents a section of the electrolytic copper foil from being exposed to the outside. If there is an exposed section, it might get oxidized, or introduce short circuiting caused by a solder during mounting of a finished thermistor.

The patterned electrodes 22 form the outer electrode 12*a,* the outer electrode 12*b* or the inner electrode 15, in a finished PTC thermistor.

As shown in FIG. 2(*c*), two conductive polymer sheets 21 and three sheets of patterned electrodes 22 are stacked alternately so that the patterned electrodes 22 come to the outermost layers. The laminate is hot pressed by a vacuum hot press for one minute at 175° C., under a vacuum of 20 Torr, and a pressure of 75 kg/cm$^2$ to form a first integrated sheet 23 shown in FIG. 3(*a*).

The first integrated sheet 23 is heat treated (at 110° C.~120° C. for one hour), and then irradiated in an electron beam apparatus at approximately 40 Mrad to cross-link the high density polyethylene.

Then, as shown in FIG. 3(*b*), a narrow and long opening 24 is provided at a predetermined interval by a dicing tool, in such a manner that a space left between the openings corresponds to length in the longer sides of a finished PTC thermistor.

The first sheet 23 provided with the openings 24 is screen-printed at the top and the bottom surfaces with an UV-curable and heat curable epoxy-modified acrylic resin, excluding a region in the vicinity of the opening 24. Then, the sheet is provisionally cured in a UV-curing oven one surface after the other surface, and then it is finally cured in a heat-curing oven with the both surfaces at once for forming a protective coating 25. The protective coating 25 forms a first protective coat 14*a* and a second protective coat 14*b,* in a finished PTC thermistor.

Referring to FIG. 3(*d*), the first sheet 23 is then wholly immersed in a nickel sulfamate bath and plated with a nickel plating layer of approximately 20 $\mu$m thick to form side electrodes 26 by coating portions of the sheet 23, which are not coated with the protective coating 25 and inner walls of the openings 24. Plating conditions are a current density of 4 A/dm$^2$ and a period of about 40 minutes. The sheet 23 as shown in FIG. 3(*d*) is then diced into individual elements to complete a finished chip PTC thermistor 27 of the present invention, as shown in FIG. 3(*e*).

Now in the following, reasons why the ratio a/t needs to be regulated to be within a certain range for a PTC thermistor to obtain a sufficiently high rising rate in the resistance is described in accordance with the present invention; where "a" represents a distance between the side electrode 13*a* and the inner electrode 15, "t" represents a thickness of the conductive polymer 11 disposed between the inner electrode 15 and the outer electrode 12*a,* or 12*b,* in FIG. 1.

As already described, if the distance "a" between the inner electrode 15 and the first side electrode 13*a* is short, the rising rate of the resistance of a PTC thermistor deteriorates. Therefore, the distance "a" needs to be regulated in order not to introduce the deterioration in the rising rate of the resistance. Meanwhile, the PTC thermistors have been made with a laminated structure in order to obtain a low resistance at the normal temperature; therefore, the distance "a" is not allowed to be very long if the effective opposing area between the outer electrode 12*a,* or the outer electrode 12*b,* and the inner electrode 15 should be large enough.

In accordance with the manufacturing method described in the present embodiment, following samples were manufactured: Thickness "t" of the conductive polymer 11 between the outer electrode 12*a,* or the outer electrode 12*b,* and the inner electrode 15 is fixed to be 0.15 mm; while electrolytic copper foils are patterned into respective patterns, so that the distance "a" between the side electrode 13*a* and the inner electrode 15 varies from 0.15 mm to 1.2 mm, at an interval of 0.15 mm.

These samples were tested in order to confirm difference in the rising rate of the resistance that might be caused by the difference in the distance "a".

Figure 4:
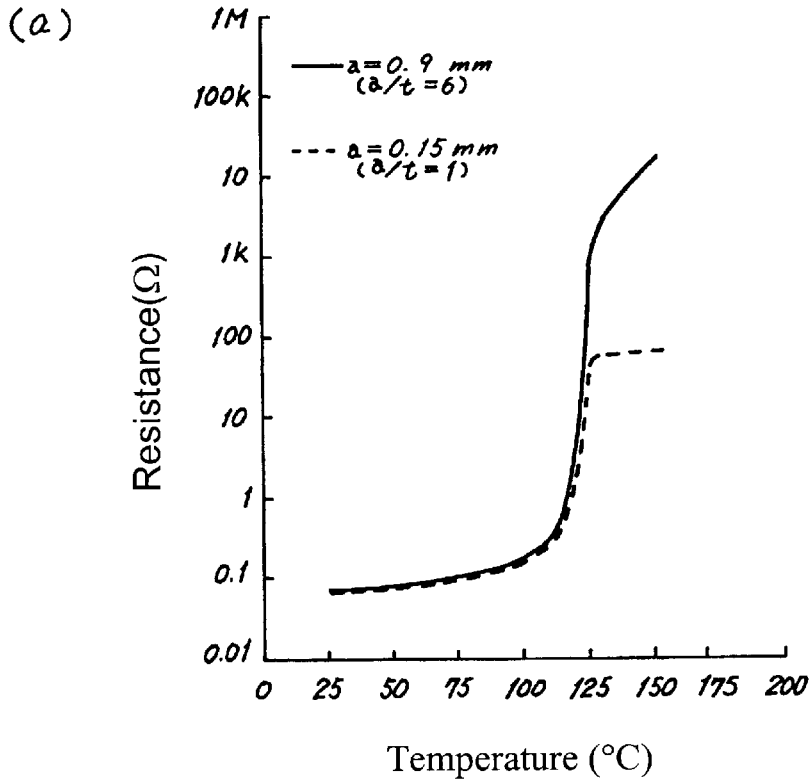
FIG. 4(*a*) is a graph showing an example of the resistance—temperature relationship in the first exemplary embodiment.
Figure 4:
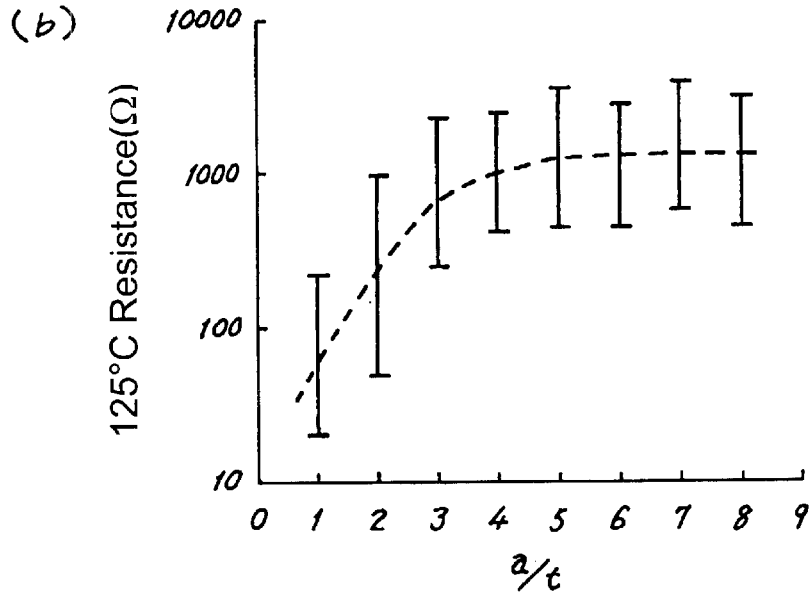

Five samples each, with which the distance "a" varies from 0.15 mm to 1.2 mm at an interval of 0.15 mm, were mounted on a printed circuit board and placed in a temperature chamber. Temperature of the chamber was raised from 25° C. to 150° C. at a speed of 2° C./min., and the resistance was measured at each temperature. FIG. 4(*a*) shows an example of the resistance/temperature characteristic, with the samples of 0.15 mm and 0.9 mm with respect to "a". FIG. 4(*b*) shows a relationship between resistance at 125° C. (R125) and the ratio a/t; "a" the distance, "t" the thickness of the conductive polymer. From FIGS. 4(*a*) and (*b*), it has been confirmed that the rising rate of the resistance goes high enough when the value a/t is greater than 3, especially when it is greater than 4. It has also been confirmed that the rising rate of the resistance does not substantially change when the value a/t is 6 or greater, and when the value a/t is 6 or greater, the initial (25° C.) resistance rises.

Since the present invention aims to provide a PTC thermistor that is suitable to the large current applications, the high initial resistance is not preferred. Thus a range of the value a/t suitable to the present invention is; not less than 3, not greater than 6; preferably not less than 4, not greater than 6.

Figure 5:
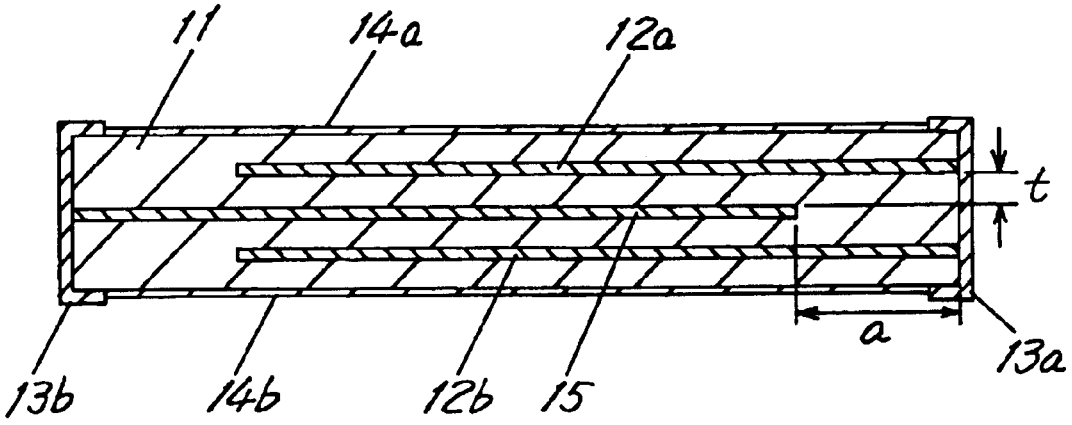
FIG. 5 is a cross sectional view of a PTC thermistor in the first exemplary embodiment.

Next, another type of chip PTC thermistor samples were manufactured by providing the conductive polymer sheet 21 on both surfaces of the sheet 23 prepared in accordance with the manufacturing method of present embodiment, where the outer electrodes 12*a,* 12*b* are located within the conductive polymer 11. A sheet 23 made by the method as described earlier with the present embodiment is sandwiched with conductive polymer sheets 21 and they are hot pressed. Then, sample chip PTC thermistors were manufactured through the same procedure as described earlier with the present embodiment. FIG. 5 shows a cross sectional view of the chip PTC thermistor. Referring to FIG. 5, thickness "t" of the conductive polymer 11 is fixed at 0.15, while the distance "a" is varied from 0.15 mm to 1.2 mm at an interval of 0.15 mm. The electrolytic copper foils are patterned accordingly. Five samples each were tested in the same manner to measure the resistance at 25° C. and 125° C., and the rising rate of the resistance value was calculated. The results confirm that, like in the earlier samples, the rising rate of the resistance becomes high when the value a/t is greater than 3, especially when it is greater than 4. When the value a/t is greater than 6, the rising rate of the resistance does not show a substantial change, and the initial (25° C.) resistance becomes high.

Figure 6:
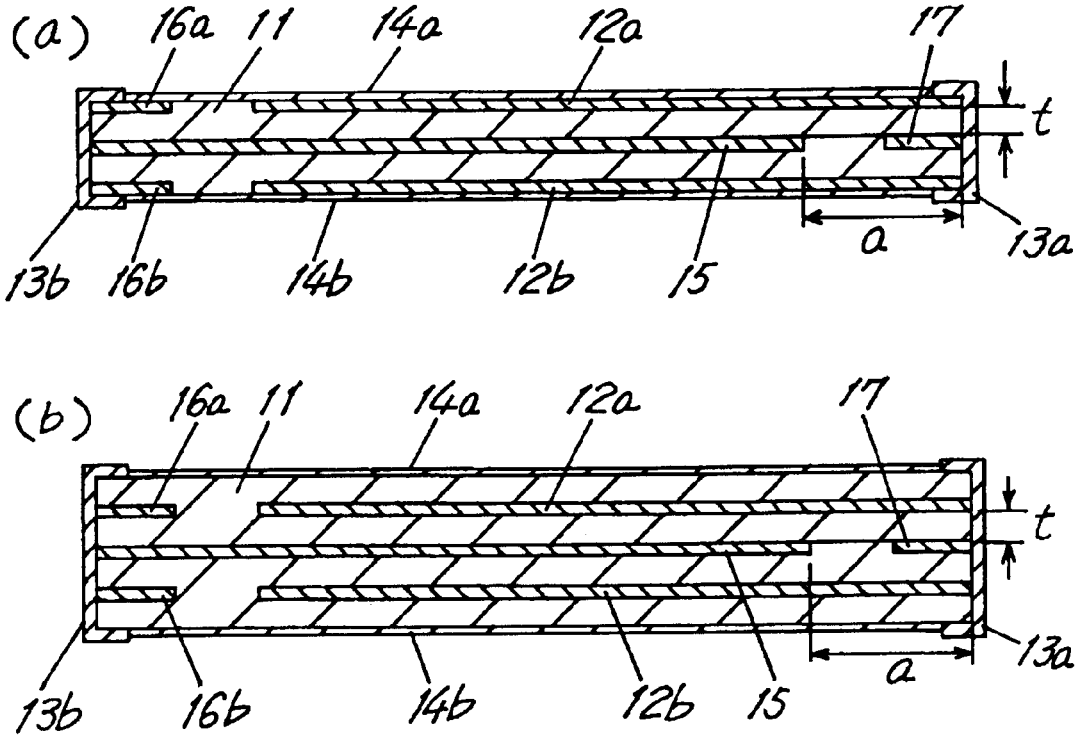
FIGS. 6(*a*), (*b*) are cross sectional views showing another PTC thermistor samples in accordance with the first exemplary embodiment.

Next, with an aim to improve reliability in the connection between the outer electrodes 12*a,* 12*b* and the side electrode 13*a,* as well as that between the inner electrode 15 and the side electrode 13*b,* chip PTC thermistor samples are prepared; in which, as shown in FIGS. 6(*a*), (*b*), a first sub electrode 16*a* is provided on a same plane of the first outer electrode 12*a,* the electrode 16*a* being independent from the outer electrode 12*a* and connected with the side electrode 13*b*. Also a second sub electrode 16*b* is provided on a same plane of the outer electrode 12*b*, the sub electrode 16*b* being independent from the outer electrode 12*b* and connected with the side electrode 13*b*. Furthermore, an inner sub electrode 17 is provided on a same plane of the inner electrode 15, the inner sub electrode 17 being independent from the inner electrode 15 and connected with the first side electrode 13*a*. The terminology, "independent", means that there is no direct electrical connection, but it does not mean to exclude an electrical coupling via the conductive polymer.

The samples were manufactured in the following manner:

Thickness "t" of the conductive polymer 11 was fixed to be 0.15 mm; each of the respective distances between the sub electrode 16*a* and the outer electrode 12*a*, between the sub electrode 16*b* and the outer electrode 12*b*, between the inner sub electrode 17 and the inner electrode 15 to be longer than 0.3 mm; while a distance "a" between the first side electrode 13*a* and the inner electrode 15 was varied from 0.45 mm to 1.2 mm, at an interval of 0.15 mm. Electrolytic copper foils were patterned accordingly. Five samples each were tested in the same manner to measure the resistance at 25° C. and 150° C., and the rising rate of the resistance was calculated. The results confirm that, like in the earlier samples, the rising rate of the resistance becomes high when the value a/t is greater than 3, especially when it is greater than 4. When the value a/t is greater than 6, the rising rate of the resistance does not show a substantial change, and the initial (25° C.) resistance becomes high.

In the description of present embodiment , the side electrode 13*a* and the side electrode 13*b* have been provided respectively as the first electrode electrically connected with the outer electrode 12*a* and the outer electrode 12*b*, and as the second electrode electrically connected with the inner electrode, which inner electrode opposing direct to the first outer electrode. However, the locations for the first electrode and the second electrode are not limited to the side faces of the conductive polymer 11. Instead, the first electrode and the second electrode may be provided in the form of a first penetrating through electrode 18*a* and a second penetrating through electrode 18*b*, as shown in FIG. 7.

Figure 7:
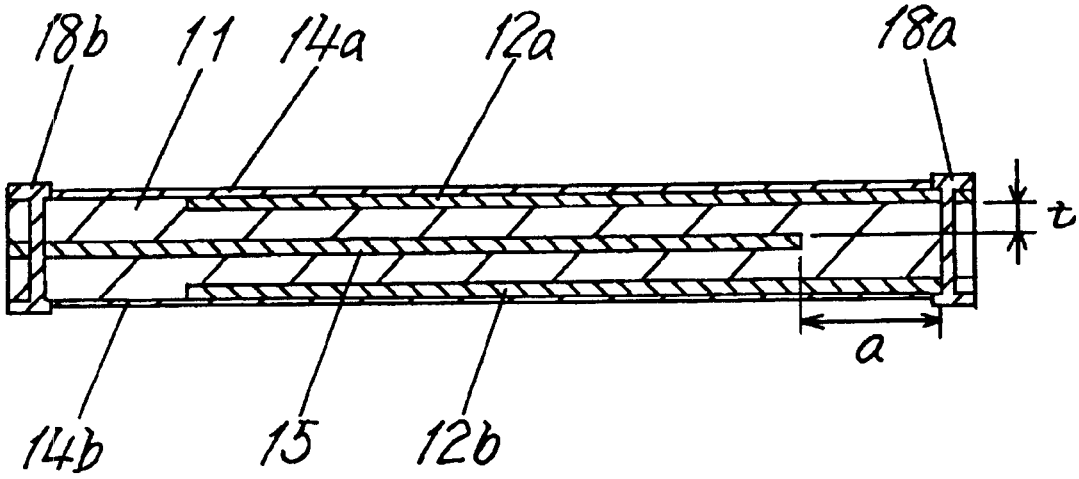
FIG. 7 is a cross sectional view showing still another example in the first exemplary embodiment.

Namely, in FIG. 7, the conductive polymer 11, the outer electrode 12*a*, the outer electrode 12*b*, the protective coating 14*a*, the protective coating 14*b* and the inner electrode 15 have been structured the same as those in the first preferred embodiment described above. The difference as compared with the first preferred embodiment (FIG. 1) is that there are a first penetrating through electrode 18*a* electrically connected with the outer electrode 12*a* and the outer electrode 12*b* and a second penetrating through electrode 18*b* electrically connected with the inner electrode 15, which directly opposing to the outer electrode 12*a*. The above-configured chip PTC thermistor also provides the same effects as provided by the present invention.

In the foregoing descriptions, the side electrode 13*a* and the side electrode 13*b* have been formed covering the whole side faces of the conductive polymer 11, and the edge regions of the outer electrode 12*a* and the outer electrode 12*b*, or extending to partly cover the first and the second surfaces of the conductive polymer 11. However, the side electrode 13*a* and the side electrode 13*b* may be provided instead on part of the side faces of the conductive polymer 11, to obtain the same effects of the present invention.

The outer electrode 12*a*, the outer electrode 12*b* and the inner electrode 15 have been made with a metal foil, in the first embodiment. However, these electrodes can be formed instead by sputtering, plasma spraying or plating of a conductive material. Or, they can be provided by first sputtering, or plasma spraying a conductive material, and then providing a plating layer thereon. Or, they can be formed using a conductive sheet. The conductive sheet can be a sheet containing either one material among the group of powdered metal, metal oxide, conductive nitride or carbide, and carbon. Furthermore, the electrodes can be formed of a conductive sheet consisting of a metal mesh and either one material among the group of powdered metal, metal oxide, conductive nitride or carbide, and carbon. Either one of the above materials provides the same effects.

Second Embodiment

Figure 8:
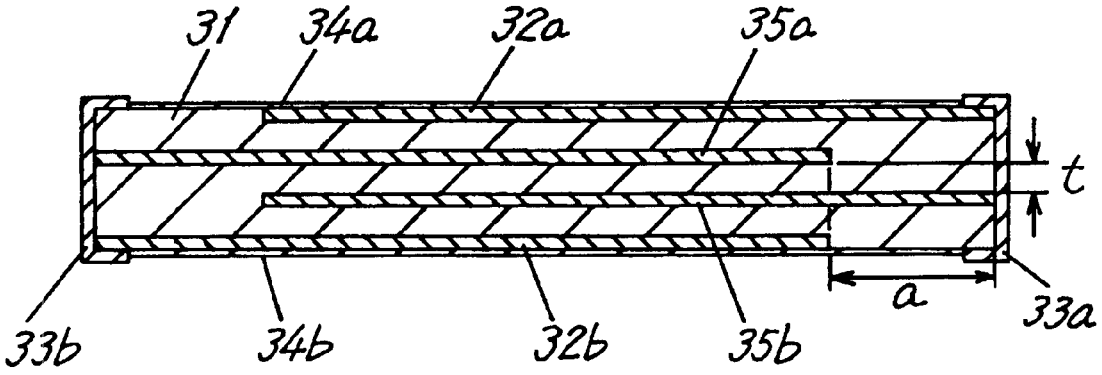
FIG. 8 is a cross sectional view showing a PTC thermistor in accordance with a second exemplary embodiment.

A chip PTC thermistor in accordance with a second exemplary embodiment of the present invention is described with reference to the drawings. FIG. 8 is a cross sectional view of the chip PTC thermistor.

In FIG. 8, a conductive polymer 31 is a mixture of a high density polyethylene and carbon black or the like, and has PTC properties. A first outer electrode 32*a* is disposed on the first surface of the conductive polymer 31, while a second outer electrode 32*b* is on the second surface. These electrodes are formed of a metal foil, such as copper, nickel or the like. A first side electrode 33*a* comprising a nickel plating layer is provided covering the entire surface of one of the side faces of the conductive polymer 31 as well as end part of the outer electrode 32*a* and the edge part of the second face of the conductive polymer 31, and is electrically connected with the first outer electrode 32*a*. A second side electrode 33*b* comprising a nickel plating layer is provided covering the entire surface of the other side face of the conductive polymer 11 as well as edge part of the first face of the conductive polymer 31 and end part of the second outer electrode 32*b*, and is electrically connected with the second outer electrode 32*b*. A first and a second protective coatings 34*a* and 34*b*, formed of an epoxy modified acrylic resin, are provided respectively on the outermost surfaces of the first surface and the second surface of the conductive polymer 31. A first and a second inner electrodes 35*a*, 35*b* are provided inside the conductive polymer 31, in parallel with the outer electrode 32*a* and the outer electrode 32*b*. The inner electrode 35*a* is electrically connected with the side electrode 33*b*, while the inner electrode 35*b* with the side electrode 33*a*. These inner electrodes are formed of a metal foil, such as copper, nickel or the like.

Now in the following, a method for manufacturing the chip PTC thermistor structured in accordance with the present embodiment is described with reference to the drawings.

Figure 9:
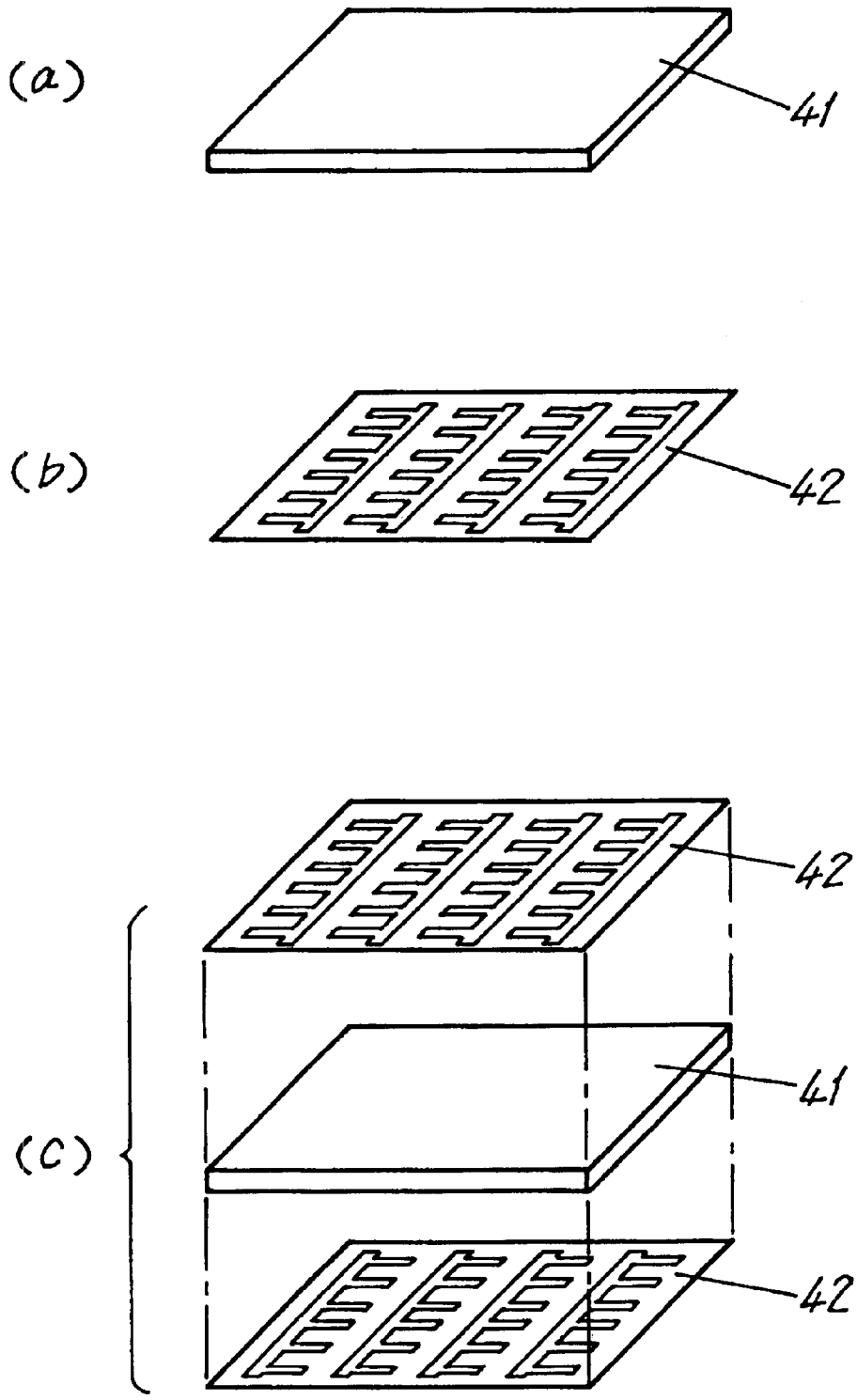
FIGS. 9(*a*)–(*c*) are flow charts showing a method of manufacturing a PTC thermistor in the second exemplary embodiment.
Figure 10:
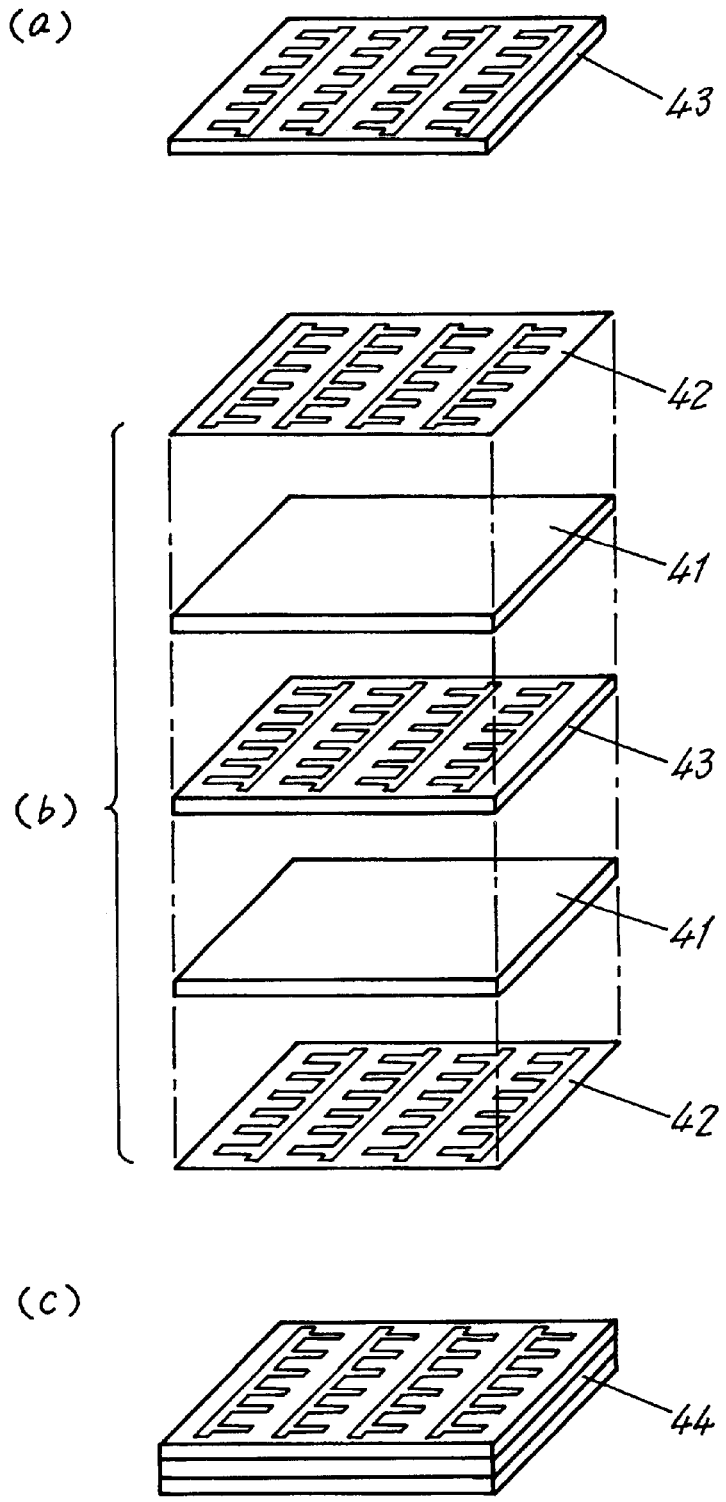
FIGS. 10(*a*)–(*c*) are flow charts showing a method of manufacturing a PTC thermistor of in the second exemplary embodiment.

FIGS. 9(*a*)–(*c*) and FIGS. 10(*a*) and (*b*) are process charts showing a manufacturing method of a chip PTC thermistor in accordance with second preferred embodiment. In the same way as in the first embodiment, a conductive polymer sheet 41 shown in FIG. 9(*a*) is prepared. An electrolytic copper foil of approximately 80 $\mu$m thick is patterned using a metal mold to form a sheet of electrodes 42 as shown in FIG. 9(*b*). The sheet of electrodes 42 are provided on both surfaces of the conductive polymer sheet 41 as shown in FIG. 9(*c*), and then they are pressed under heat and pressure to create a first integrated sheet 43 as shown in FIG. 10(*a*). Then, the first sheet 43 is sandwiched by two conductive polymers 41, and further by two sheets of electrodes 42, so that the electrodes sheet 42 come to the outermost surface as illustrated in FIG. 10(*b*). The laminate is pressed under heat and pressure to create a second integrated sheet 44 shown in FIG. 10(*c*). The rest of the procedure for manufacturing the PTC thermistors of embodiment 2 remains the same as in the first embodiment.

Samples were manufactured in accordance with the manufacturing method of the present embodiment in the following manner: thickness "t" of the conductive polymer 31 was fixed to be 0.15 mm; each of the respective distances "a" between the first and the second inner electrodes 35*a,* 35*b* and the first and the second side electrodes 33*a,* 33*b* was varied from 0.15 mm to 1.2 mm, at an interval of 0.15 mm. The electrolytic copper foils were patterned accordingly.

In order to confirm difference in the rising rate of the resistance caused by the varied distance, the samples were tested as follows.

Five samples each, with which the distance "a" varies from 0.15 mm to 1.2 mm at an interval of 0.15 mm, were mounted on a printed circuit board to be measured with respect to the resistance/temperature characteristic, in the same manner as in the first embodiment. The results confirm that the rising rate of the resistance becomes high when a value a/t is 3 or greater, especially when it is 4 or greater. It is also confirmed that the rising rate of the resistance does not substantially change when the value a/t is 6 or greater, and when the value a/t is 6 or greater, the initial (25° C.) resistance becomes high. Thus it is confirmed that the results coincide with those of the first embodiment.

Figure 11:
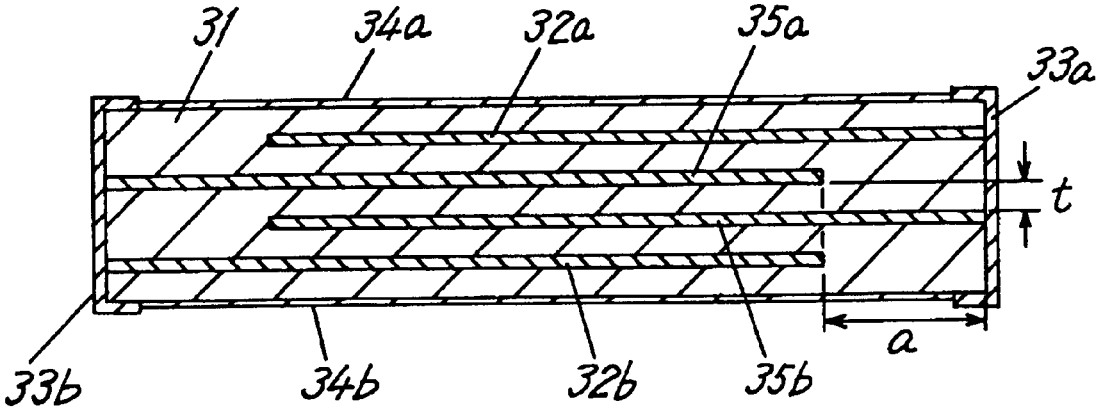
FIG. 11 is a cross sectional view showing a PTC thermistor in accordance with the second exemplary embodiment.

Next, another type of chip PTC thermistor samples were manufactured by providing the conductive polymer sheet 41 on both surfaces of the sheet 44 and applying heat and pressure thereon. Thus the outer electrodes 32*a,* 32*b* locate within the conductive polymer 31. The rest of the procedure for manufacturing the samples remains the same as that for the above second embodiment. FIG. 11 shows a cross sectional view of the chip PTC thermistor samples. Referring to FIG. 11, thickness "t" of the conductive polymer 11 was fixed at 0.15 mm, while the distance "a" was varied from 0.15 mm to 1.2 mm at an interval of 0.15 mm. Electrolytic copper foils were patterned accordingly. Five samples each were tested in the same manner to measure the resistance at 25° C. and 125° C., and the rising rate of the resistance was calculated. The results confirm that, like in the earlier samples, the rising rate of the resistance becomes high when a value a/t is 3 or greater, especially when it is 4 or greater. It is also confirmed that the rising rate of the resistance does not substantially change when the value a/t is 6 or greater, and the initial (25° C.) resistance becomes high.

Figure 12:
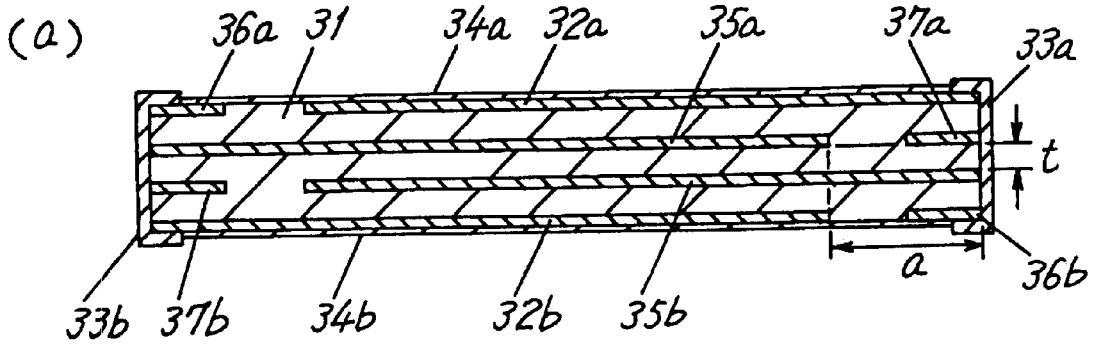
FIGS. 12(*a*), (*b*) are cross sectional views of PTC thermistors in the second exemplary embodiment.
Figure 12:
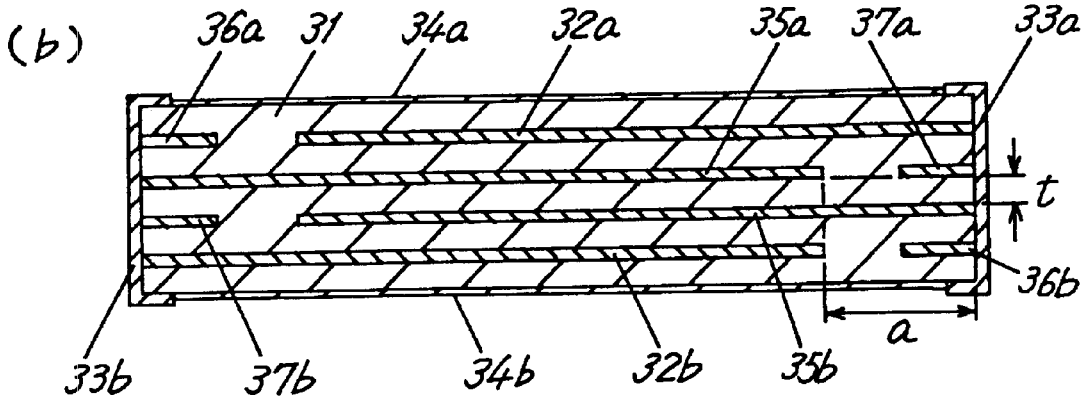

Next, with an aim to improve reliability in the connection between the outer electrode 32*a,* the inner electrode 35*b* and the first side electrode 33*a,* as well as that between the outer electrode 32*b,* the inner electrode 35*a* and the side electrode 33*b,* following chip PTC thermistor samples were manufactured. Namely, as shown in FIGS. 12(*a*) and (*b*), a first sub electrode 36*a* is provided on a same plane of the outer electrode 32*a,* sub electrode 36*a* being independent from the outer electrode 32*a* and connected with the side electrode 33*b*. Also a second sub electrode 36*b* is provided on a same plane of the outer electrode 32*b,* sub electrode 36*b* being independent from the outer electrode 32*b* and connected with the side electrode 33*a*. Furthermore, a first inner sub electrode 37*a* is provided on a same plane of the inner electrode 35*a,* inner sub electrode 37*a* being independent from the inner electrode 35*a* and connected with the side electrode 33*a*. Still further, a second inner sub electrode 37*b* is provided on a same plane of the inner electrode 35*b,* inner sub electrode 37*b* being independent from the inner electrode 35*b* and connected with the side electrode 33*b*.

The samples were manufactured in the following manner: thickness "t" of the conductive polymer 31 was fixed to be 0.15 mm; each of the respective distances between the sub electrode 36*a* and the outer electrode 32*a,* between the sub electrode 36*b* and the outer electrode 32*b,* between the inner sub electrode 37*a* and the inner electrode 35*a,* and between the inner sub electrode 37*b* and the inner electrode 35*b* was provided to be longer than 0.3 mm; and the distance "a" between the inner electrode 35*a,* 35*b* and the side electrode 33*a,* or 33*b,* was varied from 0.45 mm to 1.2 mm, at an interval of 0.15 mm. Electrolytic copper foils were patterned accordingly. Five samples each were tested in the same manner to have the resistance at 25° C. and 150° C. measured, and the rising rate of the resistance was calculated. The results confirm that, like in the earlier samples, the rising rate of the resistance becomes high when the value a/t is 3 or greater, especially when it is 4 or greater. It is also confirmed that the rising rate of the resistance does not substantially change when the value a/t is 6 or greater, and the initial (25° C.) resistance becomes high.

In the present embodiment, a side electrode 33*a* and a side electrode 33*b* have been provided respectively as the first electrode and the second electrode. However, the locations for the first electrode and the second electrode are not limited to the side faces of the conductive polymer 31. Instead, the first electrode and the second electrode can be provided in the form of a first penetrating through electrode 38*a* and a second penetrating through electrode 38*b,* as shown in FIG. 13.

Figure 13:
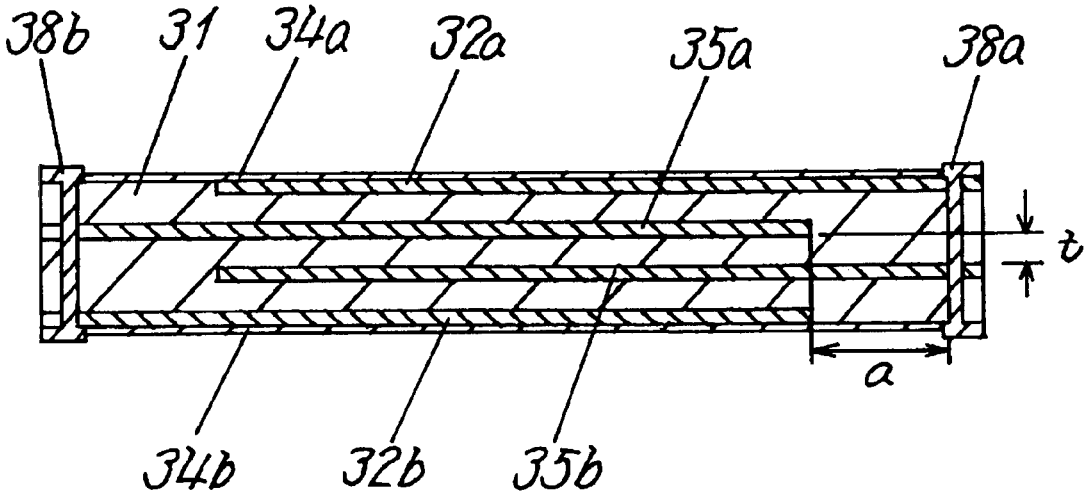
FIG. 13 is a cross sectional view showing another example of PTC thermistor in accordance with the second exemplary embodiment.

Namely, referring to FIG. 13, the conductive polymer 31, the outer electrode 32*a,* the outer electrode 32*b,* the protective coating 34*a,* the protective coating 34*b,* the inner electrode 35*a* and the inner electrode 35*b* have been structured the same as in the earlier examples. The difference is that there are a first penetrating through electrode 38*a* electrically connected with the outer electrode 32*a* and a second penetrating through electrode 38*b* electrically connected with the outer electrode 32*b*. The above-configured chip PTC thermistors also have the same effects that is provided by the present invention.

The outer electrodes, the side electrodes, the inner electrodes can be provided in the same shape and the same material as in the first embodiment.

Third Embodiment

Figure 14:
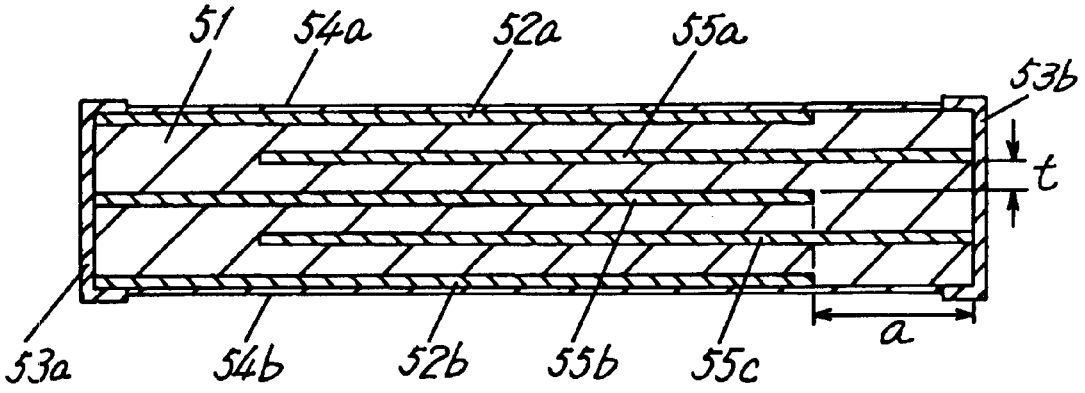
FIG. 14 is a cross sectional view showing a PTC thermistor in accordance with a third exemplary embodiment.

A chip PTC thermistor in accordance with a third exemplary embodiment of the present invention is described referring to the drawings. FIG. 14 is a cross sectional view of the chip PTC thermistor.

In FIG. 14, a conductive polymer 51 is made of a mixture of a high density polyethylene and carbon black or the like, and has a PTC property. A first outer electrode 52*a* is disposed on a first surface of the conductive polymer 51, while a second outer electrode 52*b* is on a second surface. These electrodes are formed of a metal foil, such as copper, nickel or the like. A first side electrode 53*a* comprising a nickel plating layer is provided covering the entire surface of one of the side faces of the conductive polymer 51 as well as end part of the outer electrode 52*a* and the outer electrode 52*b,* and is electrically connected with the outer electrode 52*a* and the outer electrode 52*b*. A second side electrode 53*b* comprising a nickel plating layer is provided covering the entire surface of the other side face of the conductive polymer 51 as well as end part of the first surface and the second surface of the conductive polymer 51. A first and a second protective coatings 54*a* and 54*b,* formed of an epoxy modified acrylic resin, are provided on the outermost surface of the first surface and the second surface of the conductive polymer 51. A first, a second and a third inner electrodes 55*a,* 55*b,* 55*c* are provided within the conductive polymer 51, in parallel with the outer electrodes 52*a,* 52*b*. The inner electrodes 55*a,* 55*c* are electrically connected with the side electrode 53*b,* while the inner electrode 55*b* is electrically connected with the side electrode 53*a*. These inner electrodes are formed of a metal foil, such as copper, nickel or the like.

Now in the following, a method of manufacturing the above-configured chip PTC thermistors is described with reference to the drawings.

Figure 15:
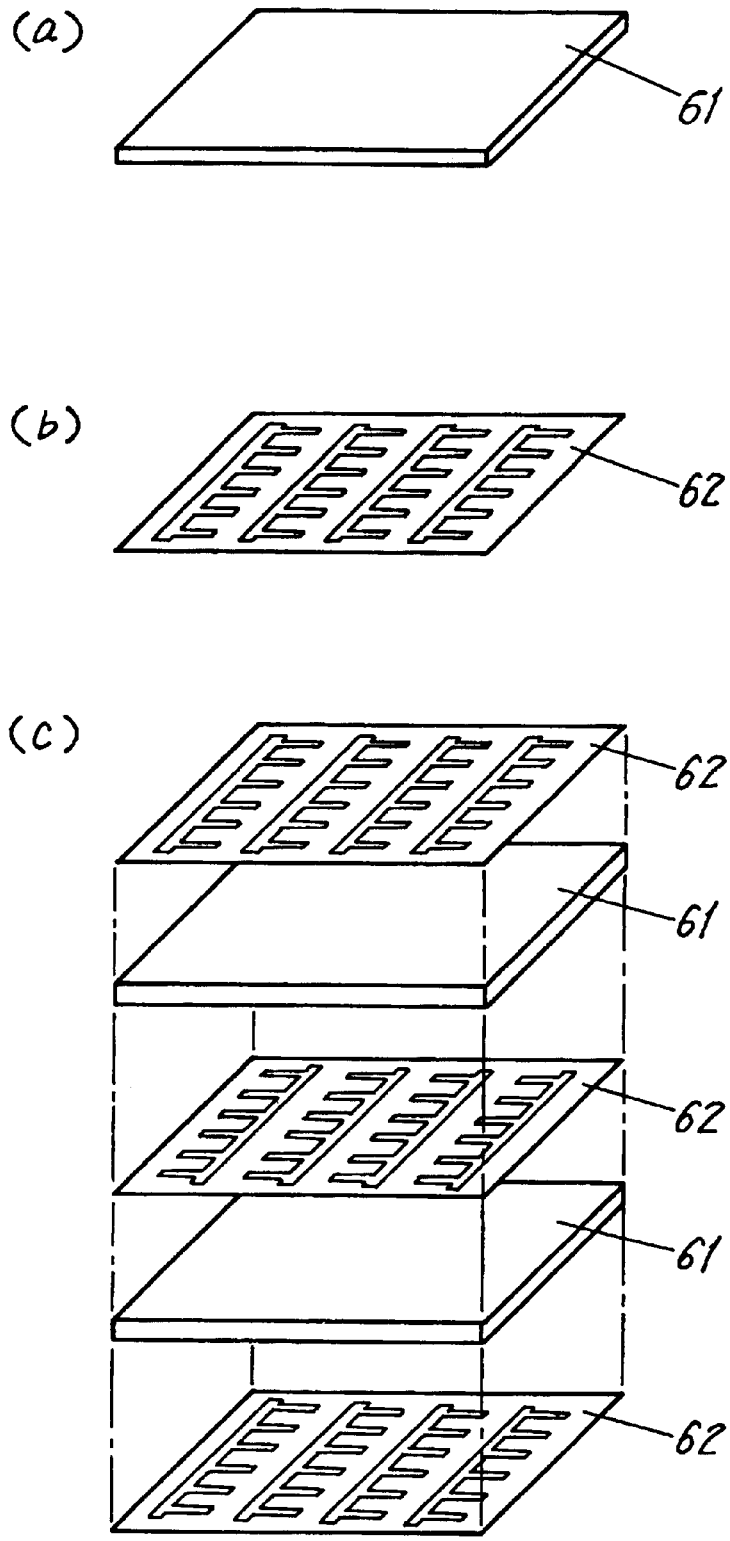
FIGS. 15 (*a*)–(*c*) are flow charts showing a method of manufacturing a PTC thermistor in the third exemplary embodiment.
Figure 16:
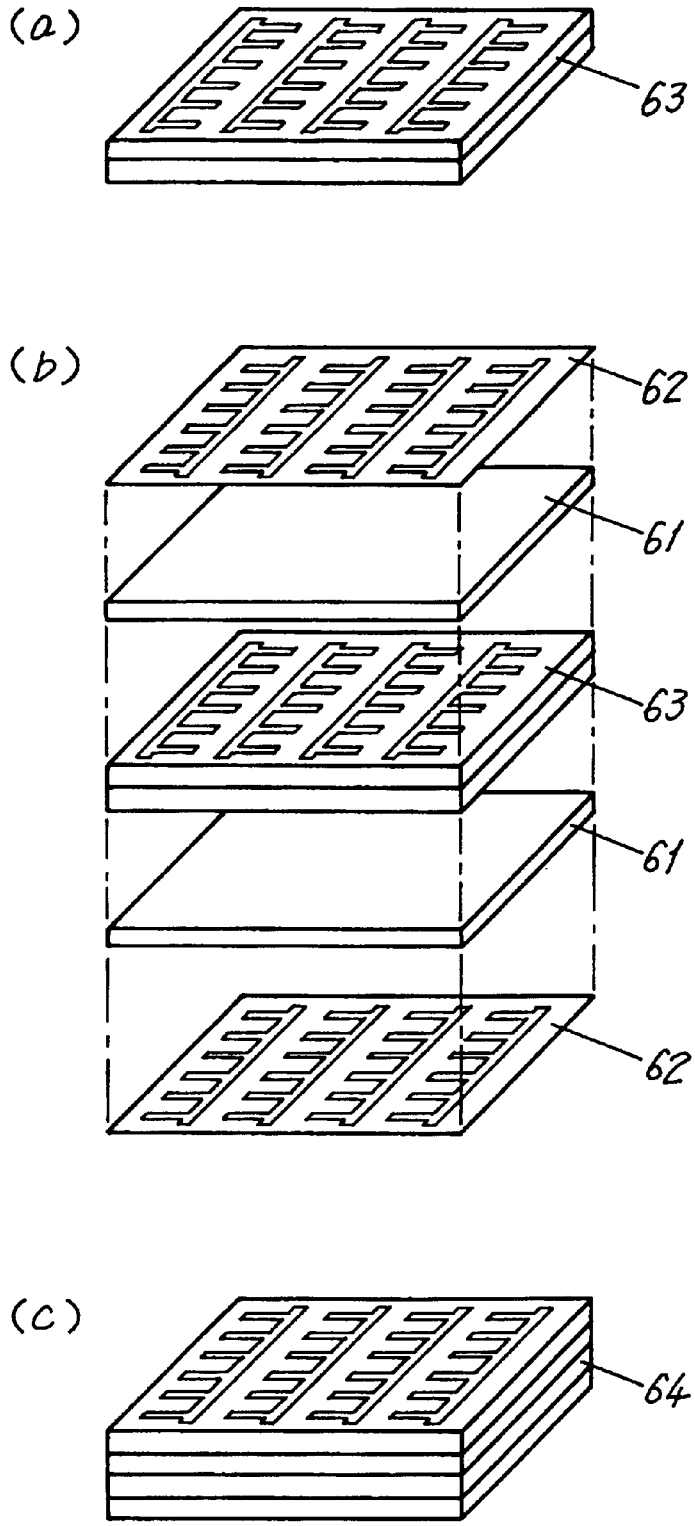
FIGS. 16(*a*)–(*c*) are flow charts showing a method of manufacturing a PTC thermistor in the third exemplary embodiment.

FIGS. 15(*a*)–(*c*) and FIGS. 16(*a*) and (*b*) are process charts showing manufacturing method of the chip PTC thermistors in accordance with third exemplary embodiment of the present invention. A conductive polymer sheet 61 shown in FIG. 15(*a*) is prepared in the same way as in the first embodiment. An electrolytic copper foil of approximately 80 μm thick is patterned using a metal mold to provide a sheet of electrodes 62 as shown in FIG. 15(*b*). The conductive polymer 61 forms the conductive polymer 51 when a finished PTC thermistor is completed; likewise, the electrodes 62 forms the first outer electrode 52*a*, the second outer electrode 52*b* and the first through the third inner electrodes 55*a*–55*c*. Then, as shown in FIG. 15(*c*), two sheets of the conductive polymer 61 and three sheets of the electrodes 62 are laminated one on the other, so that the electrodes 62 come to the outermost. The laminate is pressed under heat and pressure to prepare an integrated sheet 63 shown in FIG. 16(*a*). The sheet 63 is sandwiched by two sheets of the conductive polymer 61, and by two sheets of electrodes 62 so that the electrodes 62 come to the outermost. The laminate is pressed under heat and pressure to prepare an integrated sheet 64 shown in FIG. 16(*c*). Then, it undergoes the same manufacturing procedure as in the first embodiment, and chip PTC thermisor samples of third embodiment are manufactured.

Now in the following, reasons why the ratio a/t needs to be regulated to be within a certain range for a PTC thermistor in the present embodiment to obtain a sufficiently high rising rate in the resistance is described; where "a" represents a distance between the first, second, third inner electrodes 55*a*, 55*b*, 55*c* and the side electrode 53*a*, or 53*b*, "t" represents a thickness of the conductive polymer 51.

Samples were manufactured in accordance with the manufacturing method of present embodiment in the following manner: thickness "t" of the conductive polymer was fixed to be 0.15 mm; while the distance "a" was varied from 0.15 mm to 1.2 mm, at an interval of 0.15 mm. The electrolytic copper foils were patterned accordingly.

In order to confirm difference in the rising rate of the resistance caused by the varied distance "a", the samples were tested as follows.

Five samples each, with which the distance "a" varies from 0.15 mm to 1.2 mm at an interval of 0.15 mm, were mounted on a printed circuit board to be measured with respect to the resistance/temperature characteristic, in the same manner as in the first embodiment. It is confirmed that the rising rate of the resistance is high when the value a/t is 3 or greater, especially when it is 4 or greater. It is also confirmed that the rising rate of the resistance does not substantially change where the value a/t is 6 or greater, and the initial (25° C.) resistance becomes high.

Figure 17:
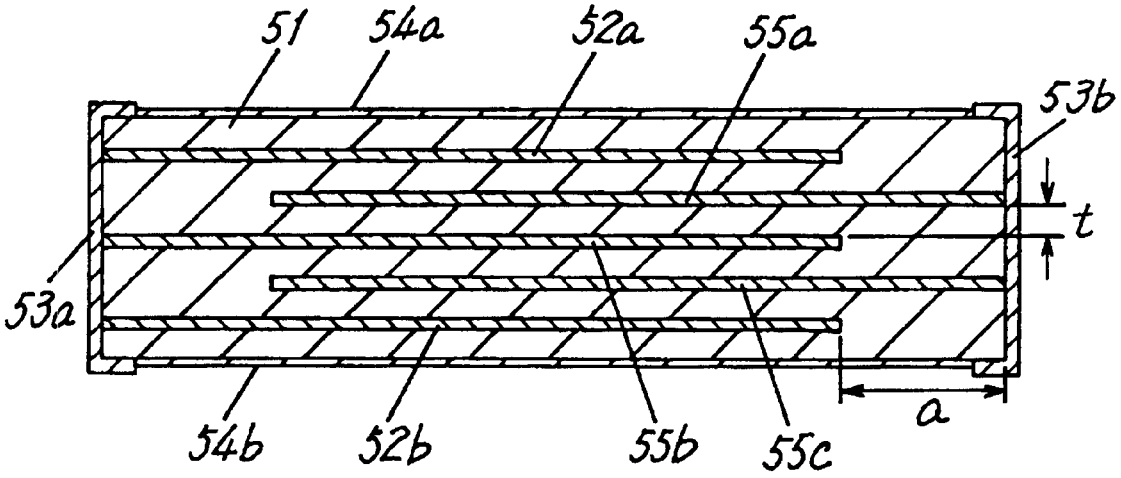
FIG. 17 is a cross sectional view showing a PTC thermistor in accordance with the third exemplary embodiment.

Next, another type of chip PTC thermistor samples were manufactured by providing the conductive polymer sheet 61 on both surfaces of the sheet 64, and the laminate was heated and pressed, so that the outer electrodes 52*a*, 52*b* locate within the conductive polymer 51. Then, it underwent the same manufacturing procedure as the above third embodiment, to have the chip PTC thermistor samples manufactured. FIG. 17 shows a cross sectional view of the chip PTC thermistor. Thickness "t" of the conductive polymer 51 was fixed at 0.15 mm, while the distance "a" was varied from 0.15 mm to 1.2 mm at an interval of 0.15 mm. Electrolytic copper foils were patterned accordingly. Five samples each were tested in the same manner to measure the resistance at 25° C. and 125° C., and the rising rate of the resistance was calculated. The results confirm that, like in the earlier samples, the rising rate of the resistance becomes high when the value a/t is 3 or greater, especially when it is 4 or greater. It is also confirmed that when the value a/t is 6 or greater, the rising rate of the resistance does not show a substantial change, and the initial (25° C.) resistance becomes high.

Figure 18:
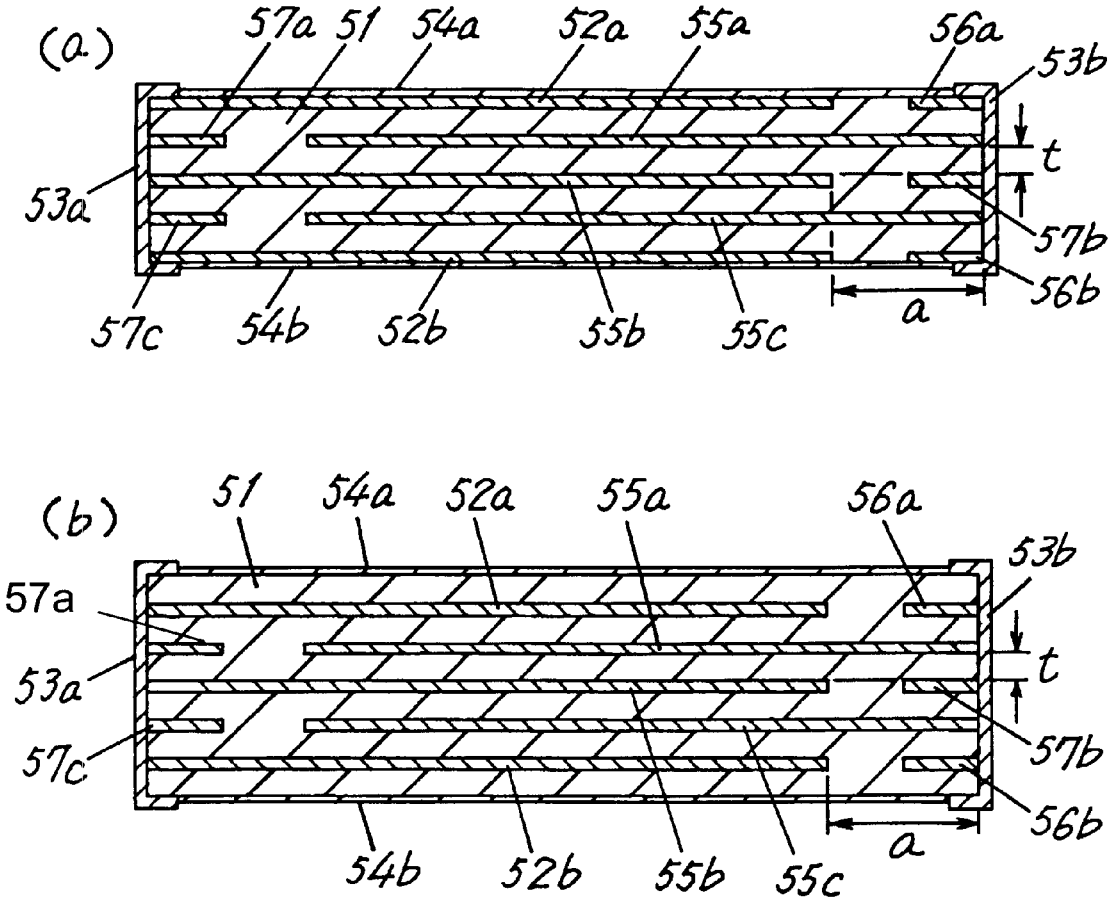
FIGS. 18(*a*), (*b*) are cross sectional views of PTC thermistors in the third embodiment.

Next, with an aim to improve reliability in the connection between the first outer electrode 52*a*, the second outer electrode 52*b*, the second inner electrode 55*b* and the first side electrode 53*a*, as well as that between the first and the third inner electrodes 55*a*, 55*c* and the second side electrode 53*b*, following chip PTC thermistor samples were prepared. Namely, as shown in FIGS. 18(*a*) and (*b*), a first sub electrode 56*a* is provided on a same plane of the outer electrode 52*a*, sub electrode 56*a* being independent from the outer electrode 52*a* and connected with the side electrode 53*b*. Also a second sub electrode 56*b* is provided on a same plane of the outer electrode 52*b*, sub electrode 56*b* being independent from the outer electrode 52*b* and connected with the second side electrode 53*b*. Furthermore, a first inner sub electrode 57*a* is provided on a same plane of the inner electrode 55*a*, inner sub electrode 57*a* being independent from the inner electrode 55*a* and connected with the side electrode 53*a*. Still further, a second inner sub electrode 57*b* is provided on a same plane of the inner electrode 55*b*, inner sub electrode 57*b* being independent from the inner electrode 55*b* and connected with the side electrode 53*b*. Still further, a third inner sub electrode 57*c* is provided on a same plane of the inner electrode 55*c*, inner sub electrode 57*c* being independent from the inner electrode 55*c* and connected with the side electrode 53*a*.

The samples were manufactured in the following manner: thickness "t" of the conductive polymer 51 was fixed to be 0.15 mm; each of the respective distances between the sub electrode 56*a* and the outer electrode 52*a*, between the sub electrode 56*b* and the outer electrode 52*b*, between the inner sub electrode 57*a* and the inner electrode 55*a*, between the inner sub electrode 57*b* and the inner electrode 55*b*, and between the inner sub electrode 57*c* and the inner electrode 55*c* to be longer than 0.3 mm; and the distance "a" between the first, second, third inner electrodes 55*a*, 55*b*, 55*c* and the side electrode 53*a*, or 53*b*, was varied from 0.45 mm to 1.2 mm, at an interval of 0.15 mm. The electrolytic copper foils were patterned accordingly. Five samples each were tested in the same manner to measure the resistance at 25° C. and 150° C., and the rising rate of the resistance was calculated. The results confirm that, like in the earlier samples, the rising rate of the resistance becomes high when the value a/t is 3 or greater, especially when it is 4 or greater. It is also confirmed that when the value a/t is 6 or greater, the rising rate of the resistance does not show a substantial change, and the initial (25° C.) resistance becomes high.

In the present embodiment, the side electrode 53*a* and the side electrode 53*b* have been provided respectively as a first electrode and a second electrode. However, the locations for the first electrode and the second electrode are not limited to the side faces of the conductive polymer 51. Instead, the first electrode and the second electrode can be a first penetrating through electrode 58*a* and a second penetrating through electrode 58*b* as shown in FIG. 19.

Figure 19:
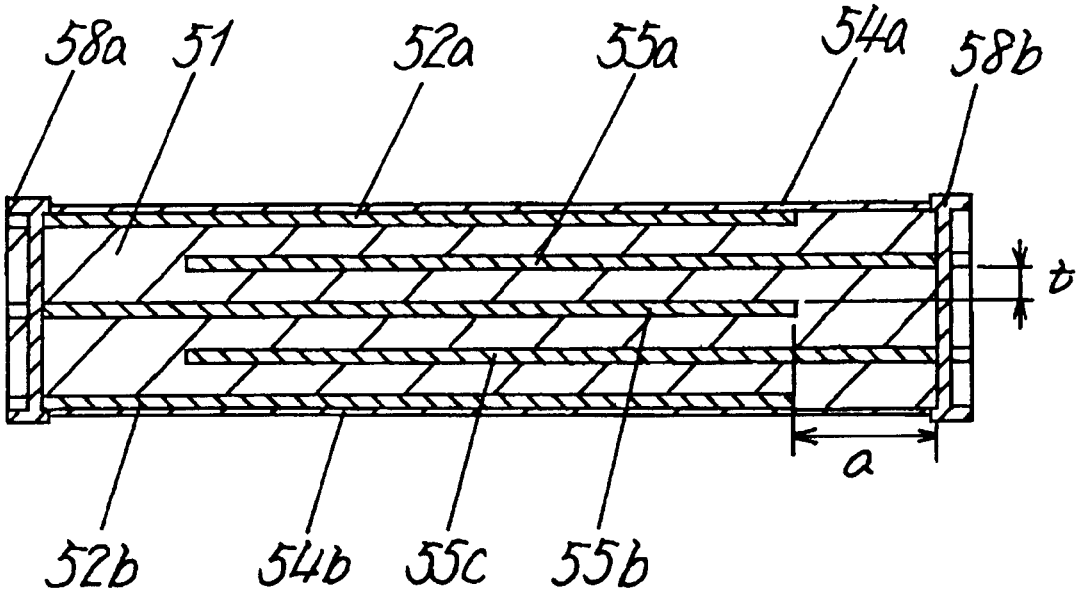
FIG. 19 is a cross sectional view showing another example of PTC thermistor in accordance with the third exemplary embodiment.
Figure 20:
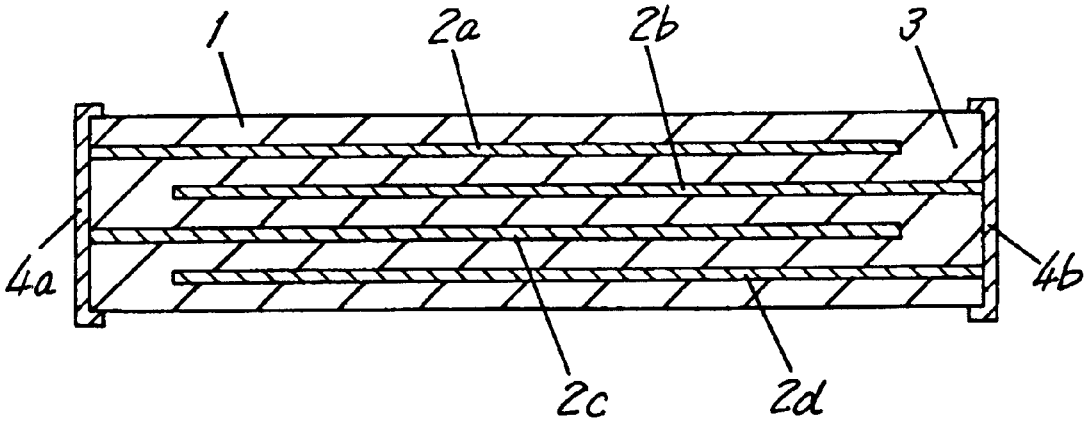
FIG. 20 is a cross sectional view of a conventional PTC thermistor.

Namely, referring FIG. 19, the conductive polymer 51, the outer electrode 52*a*, the outer electrode 52*b*, the protective coatings 54*a,* 54*b,* the inner electrode 55*a,* the inner electrode 55*b* and the inner electrode 55*c* have been structured the same as those in the present embodiment. The difference as compared with the above third embodiment (FIG. 14) is that there are a first penetrating through electrode 58*a* which is electrically connected with the outer electrodes 52*a,* 52*b* and a second penetrating through electrode 58*b* which is electrically connected with the inner electrodes directly opposing to the outer electrodes. The above-configured chip PTC thermistors also provide the same effects as those of above third embodiment.

The shapes, materials and the like for the outer electrode, side electrode, inner electrode can be the same as in the first embodiment.

In the foregoing descriptions, a high density polyethylene has been used as the material for the crystalline polymer. However, as readily understood from the functioning mechanism, the material in the present invention is not limited to the high density polyethylene. The present invention can be applied in all the PTC thermistors that comprise polyvinylidene fluoride, PBT resin, PET resin, polyamide resin, PPS resin or the like crystalline polymers.

Industrial Applicability

The PTC thermistors of the present invention employ a conductive polymer having the PTC property, and a ratio a/t is regulated within a range 3–6; where "a" represents a distance between a first electrode, or a second electrode, and the adjacent inner electrode, while "t" represents a distance between each of the inner electrodes, or between the first, or the second, outer electrode and the adjacent inner electrode. With the above-described structure in accordance with the present invention, resistance of a PTC thermistor can be suppressed at a low level, so it is usable for large current applications. In addition, it provides a sufficient rate of the resistance rise. Thus the PTC thermistors in accordance with the present invention can effectively work to prevent an overcurrent in large current circuits.

What is claimed is:

1. A chip polymer PTC thermistor comprising:

a conductive polymer having PTC properties;

a first outer electrode in contact with said conductive polymer;

a second outer electrode sandwiching said conductive polymer with said first outer electrode;

one or more inner electrode disposed in between and parallel to said first and second outer electrodes, said one or more inner electrode being sandwiched by said conductive polymer;

a first electrode directly electrically coupled with said first outer electrode; and a second electrode disposed electrically independently from said first electrode;

wherein, when defining an inner electrode placed at the most adjacent to said first outer electrode as "one", and defining a "n"th inner electrode counting from the "one" as a "n"th inner electrode, odd-numbered inner electrodes are directly coupled with said second electrode and even-numbered inner electrodes, with said first electrode, and when the total number of said inner electrodes is an odd number, said second outer electrode is electrically directly coupled with said first electrode, whereas when it is an even number, coupled with said second electrode; wherein, defining a distance from said odd-numbered inner electrode to said first electrode, or from said even-numbered inner electrode to said second electrode as "a", and a distance between the adjacent inner electrodes among said inner electrodes, or a distance between the inner electrode adjacent to said first outer electrode, or said second outer electrode, and said first outer electrode, or said second outer electrode, as "t", a ratio a/t is within a range 3–6, and wherein said ratio a/t is increased by maintaining "t" and increasing "a" in order to increase resistance of said thermistor.

2. The chip polymer PTC thermistor of claim 1, wherein said first electrode is a first side electrode provided on one of the side faces of said conductive polymer, while said second electrode is a second side electrode provided on the other side face of said conductive polymer.

3. The chip polymer PTC thermistor of claim 1, wherein said first electrode is a first through electrode provided penetrating in said conductive polymer at one end, while said second electrode is a second through electrode provided penetrating in said conductive polymer at the other end.

4. The chip polymer PTC thermistor of claim 1, wherein said first electrode is a first side electrode provided on one of the side faces of said conductive polymer, said first side electrode making direct electrical contact with said first outer electrode and said even-numbered inner electrode, while said second electrode is a second side electrode provided on the other side face of said conductive polymer, said second side electrode making direct electrical contact with said odd-numbered inner electrode; and when the total number of said inner electrodes is an odd number, said second outer electrode makes direct electrical contact with said first side electrode, whereas when the total number of said inner electrodes is an even number, said second outer electrode makes direct electrical contact with said second side electrode.

5. The chip polymer PTC thermistor of claim 1, wherein said ratio a/t is within a range 4–6.

6. A chip polymer PTC thermistor comprising:

a conductive polymer having PTC properties;

a first outer electrode in contact with said conductive polymer;

a second outer electrode sandwiching said conductive polymer with said first outer electrode;

one or more inner electrode disposed in between and parallel to said first and second outer electrodes and sandwiched by said conductive polymer;

a first outer sub electrode disposed on a same plane with said first outer electrode, said first outer sub electrode being separated from said first outer electrode with a certain specific distance while being in contact with said conductive polymer;

a second outer sub electrode disposed on a same plane with said second outer electrode, said second outer sub electrode being separated from said second outer electrode with a certain specific distance while being in contact with said conductive polymer;

inner sub electrodes provided for a same number of said inner electrodes, each of said sub electrodes being disposed on same planes with said respective inner electrodes and separated from said inner electrode with a certain specific distance while in contact with said conductive polymer;

a first electrode directly electrically coupled with said first outer electrode;

a second electrode disposed electrically independently from said first electrode, and making direct electrical contact with said first outer sub electrode;

wherein, when defining an inner electrode placed at the most adjacent to said first outer electrode as "one", and defining a "n"th inner electrode counting from the "one" as a "n"th inner electrode, odd-numbered inner electrodes and even-numbered inner sub electrodes are directly coupled with said second electrode, and even-numbered inner electrodes and odd-numbered inner sub electrodes are directly coupled with said first electrode, and when the total number of said inner electrodes is an odd number, said second outer electrode is electrically directly coupled with said first electrode, and said second outer sub electrode is electrically directly coupled with said second electrode, when it is an even number, said second outer electrode is electrically directly coupled with said second electrode, and said second outer sub electrode is electrically directly coupled with said first electrode; wherein, defining a distance from said odd-numbered inner electrode to said first electrode, or from said even-numbered inner electrode to said second electrode as "a", whereas a distance between the adjacent inner electrodes among said inner electrodes, or a distance between the inner electrode disposed next to said first outer electrode, or said second outer electrode, and said first outer electrode, or said second outer electrode, as "t", a ratio a/t is within a range 3–6, and wherein said ratio a/t is increased by maintaining "t" and increasing "a" in order to increase resistance of said thermistor.

7. The chip polymer PTC thermistor of claim 6, wherein said first electrode is a first side electrode provided on one of the side faces of said conductive polymer, while said second electrode is a second side electrode provided on the other side face of said conductive polymer.

8. The chip polymer PTC thermistor of claim 6, wherein said first electrode is a first through electrode provided penetrating in said conductive polymer at one end, while said second electrode is a second through electrode provided penetrating in said conductive polymer at the other end.

9. The chip polymer PTC thermistor of claim 6, wherein said first electrode is a first side electrode provided on one of the side faces of said conductive polymer, said first side electrode making direct electrical contact with said first outer electrode, said even-numbered inner electrode and said odd-numbered inner sub electrode, while said second electrode is a second side electrode provided on the other side face of said conductive polymer, said second side electrode making direct electrical contact with said first outer sub electrode, said odd-numbered inner electrode and said even-numbered inner sub electrode; wherein when the total number of said inner electrodes is an odd number, said second outer electrode makes direct electrical contact with said first side electrode, and said second outer sub electrode makes direct electrical contact with said second side electrode, when the total number of said inner electrodes is an even number, said second outer electrode makes direct electrical contact with said second side electrode, and said second outer sub electrode makes direct electrical contact with said first side electrode.

10. The chip polymer PTC thermistor of claim 6, wherein said ratio a/t is within a range 4–6.

11. A thermistor, comprising:

a polymer having conductive filler;

first and second side electrodes on different sides of said polyer;

an upper electrode extending from said first side electrode towards and spaced away from said second side electrode;

an inner electrode extending from said second side electrode towards and spaced away from said first side electrode;

wherein said inner electrode is spaced away from said first side electrode by a distance "a", said inner electrode is spaced away from said upper electrode by a distance "t", and wherein a/t is in the range of 3–6.

12. A thermistor according to claim 11 further comprising a further inner electrode extending from said first side electrode towards said second side electrode.

13. A thermistor according to claim 11, wherein a portion of said upper electrode is directly over at least a portion of said inner electrode.

14. A thermistor according to claim 11, wherein said inner electrode is buried in said polymer.

* * * * *